US007675226B2

(12) United States Patent
Murray et al.

(10) Patent No.: US 7,675,226 B2
(45) Date of Patent: Mar. 9, 2010

(54) HIGH-FREQUENCY, HIGH-VOLTAGE ELECTRON SWITCH

(75) Inventors: Robert Carl Murray, Rotterdam, NY (US); Karim Younsi, Ballston Lake, NY (US); Fengfeng Tao, Clifton Park, NY (US); Seyed Gholamali Saddoughi, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 503 days.

(21) Appl. No.: 11/690,918

(22) Filed: Apr. 17, 2007

(65) Prior Publication Data

US 2008/0258600 A1 Oct. 23, 2008

(51) Int. Cl.
*H01J 29/70* (2006.01)

(52) U.S. Cl. ..... 313/421; 313/432; 313/439; 313/440

(58) Field of Classification Search ..... 313/409–415, 313/421, 432, 439, 440
See application file for complete search history.

(56) References Cited

U.S. PATENT DOCUMENTS 3,614,694 A * 10/1971 Koontz ..... 336/174
3,673,528 A * 6/1972 Hughes ..... 335/210
3,875,586 A * 4/1975 Ishibashi et al. ..... 348/293
3,878,532 A * 4/1975 Buck ..... 341/10
3,893,165 A * 7/1975 Sunstein ..... 348/811
3,935,500 A 1/1976 Oess et al.
6,184,615 B1 * 2/2001 Tobari ..... 313/435

* cited by examiner

*Primary Examiner*—Nimeshkumar D. Patel
*Assistant Examiner*—Mary Ellen Bowman
(74) *Attorney, Agent, or Firm*—Francis T. Coppa

(57) ABSTRACT

A high-frequency, high-voltage electron switch includes an electron source, a steering mechanism, a mask or anode plate, and a target. The electron source produces a beam of electrons with a voltage of at least about 1 kV that impinges upon the anode plate. The steering mechanism scans the electron beam across the anode plate at a scanning frequency of at least about 10 MHz. A hole or aperture is provided in the anode plate that allows the electron beam to pass through and produce a pulsed, high-voltage current in the target with a very high-frequency repetition rate and a very fast rise time. The pulsed, high-voltage current produced in the target can be used to cause a high-voltage source to turn on and off.

19 Claims, 1 Drawing Sheet

HIGH-FREQUENCY, HIGH-VOLTAGE ELECTRON SWITCH

BACKGROUND

Figure 1:
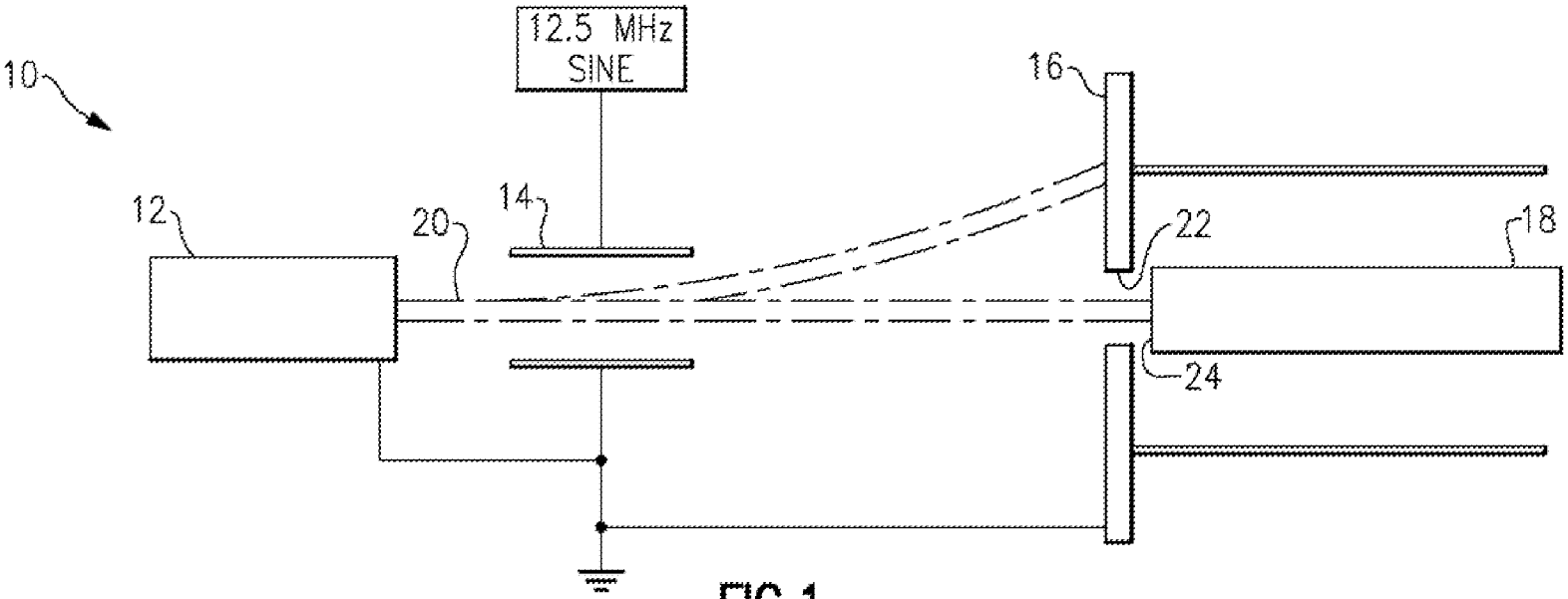

The invention relates generally to a device to switch electrical current, and in particular, to an electron switch that switches electrical current at a high voltage (tens of kilovolts), over sub-nanosecond rise times, and at repetition rates of tens of megahertz.

The cathode ray tube (CRT) was invented by German physicist Karl Ferdinand Braun in 1897. The CRT is the display device that was first used for computer displays, video monitors, televisions, radar displays and oscilloscopes. The CRT developed from Philo Farnsworth's work was used in all television sets until the 1990s and the development of practical plasma screens, liquid crystal display (LCD) televisions, digital light processing (DLP), organic light-emitting diode (OLED) displays, and other technologies. As a result of CRT technology, television has acquired the moniker "the tube" even when referring to non-CRT sets.

A cathode ray tube technically refers to any electronic vacuum tube employing a focused beam of electrons. Cathode rays exist in the form of streams of high speed electrons emitted from the heating of a cathode inside a vacuum tube at its rear end. The emitted electrons form a beam within the tube due to the voltage difference applied across the two electrodes. The beam is then perturbed (deflected) either by a magnetic or an electric field, to trace over ("scan") the inside surface of the screen (anode). The screen is covered with a phosphorescent coating (often transition metals or rare earth elements), which emits visible light when excited by the electrons.

In television sets and modern computer monitors, the entire front area of the tube is scanned systematically in a fixed pattern called a raster. An image is produced by modulating the intensity of the electron beam with a received video signal (or another signal derived from it). In all modern television sets, the beam is deflected with a magnetic field applied to the neck of the tube with a "magnetic yoke", a set of wire coils driven by electronic circuits. This usage of electromagnets to change the electron beam's original direction is known as "magnetic deflection".

The source of the electron beam is the electron gun, which produces a stream of electrons through thermionic emission (also known as the Edison effect), and focuses the electrons into a thin beam. The gun is located in the narrow, cylindrical neck at the extreme rear of a cathode ray tube (CRT), and has electrical connecting pins, usually arranged in a circular configuration, extending from its end. These pins provide external connections to the cathode, to various grid elements in the gun used to focus and modulate the beam, and, in electrostatic deflection CRTs, to the deflection plates. Because the CRT is a hot-cathode device, these pins also provide connections to one or more filament heaters with the electron gun. The electron beam is typically modulated at frequencies of about 1 MHz. The electron beam can also be produced using cold emission. In this case, a single or multiple sharp radius conductors are energized at high enough voltage in vacuum to create an electron emission into vacuum. The electrons are then accelerated similarly to a CRT.

The high voltage (EHT) used for accelerating the electrons is provided by a transformer. For CRTs used in televisions, this is usually a flyback transformer that steps up the line (horizontal) deflection supply to as much as 32 kV for a color tube (Monochrome tubes and specialty CRTs may operate at much lower voltages). The output of the transformer is rectified and the pulsating output voltage is smoothed by a capacitor formed by the tube itself (the accelerating anode being one plate, the glass being the dielectric, and the grounded (earthed) coating on the outside of the tube being the other plate). In the earliest televisions, before the invention of the flyback transformer design, a linear high-voltage supply was used because these supplies were capable of delivering much more current at their high voltage than flyback high voltage systems. However, in the case of an accident, they proved extremely deadly. The flyback circuit design addressed this; in the case of a fault, the flyback system delivers relatively little current, making a person's chance of surviving a direct shock from the high voltage anode lead more hopeful (though by no means guaranteed).

For use in an oscilloscope, the design is somewhat different. Rather than tracing out a raster, the electron beam is directly steered along an arbitrary path, while its intensity is kept constant. In time-domain mode, the usual mode, the horizontal deflection is proportional to time (measured out by a "sweep oscillator" in the oscilloscope, visually progressing across the screen at a constant rate), and the vertical deflection is proportional to the measured signal(s). In the less-common X-Y mode, both the horizontal and vertical deflections are proportional to measured signals. The electron gun is always centered in the tube neck; the problem of ion production is either ignored or mitigated by using an aluminized screen.

Tubes designed for oscilloscope use are longer and narrower than tubes designed for raster scan use, greatly reducing the maximum deflection angle required. This allows for the use of electrostatic deflection instead of magnetic deflection. In this case, deflection is caused by applying an electrical field via deflection plates built into the tube's neck. This method allows the electron beam to be steered much more rapidly than with a magnetic field, where the inductance of the electromagnets imposes relatively severe limits on the maximum frequency in the signal that can be accurately represented. The reduced deflection angle also removes any need for dynamic focusing of the electron beam (which would be difficult to accomplish at the required high deflection speeds). Finally, the limited angle makes it much easier to ensure that the beam deflection produced is a linear function of the signal being traced.

To date, there are no devices that provide a multi-kilovolt pulse of at least 1 kV, a repetition rate exceeding 10 MHz and a nanosecond rise time. Therefore, it is desirable to provide a switching device that produces high-voltage pulses, high-frequency repetition rates and nanosecond rise times.

BRIEF DESCRIPTION

Briefly, an electron switch is comprised of an electron source for emitting a beam of electrons having a beam energy or voltage $V_{beam}$ of at least about 1 kV and a current $I_{beam}$ of at least about 1 amp. A steering mechanism deflects the beam of electrons at a scanning frequency of at least about 10 MHz. A mask has an aperture such that the deflected beam of electrons are scanned across the mask at the scanning frequency. The beam of electrons passing through the aperture strikes a target and cause a pulsed, high-voltage current in the target.

In another aspect of the invention, a high-voltage, high frequency electron switch comprises an electron gun that produces a beam of electrons with a voltage of at least 1 kV. An electrostatic yoke deflects the beam of electrons at a scanning frequency of at least 10 MHz. An anode plate has an aperture such that the beam of electrons pass through the aperture at twice the scanning frequency. The beam of electrons passing through the aperture and striking a target produce a pulsed, high-voltage current in the target having a pulse amplitude determined by an impedance of the target and the current of the beam of electrons, a pulse width determined by a size of the aperture and the scanning frequency, and a rise time determined by a beam size and the scanning frequency.

In yet another aspect of the invention, a method for making an electron switch comprises the steps of:

emitting a beam of electrons having a beam energy or voltage $V_{beam}$ of at least about 1 kV and a current $I_{beam}$ of at least about 1 amp; and deflecting the beam of electrons at a scanning frequency of at least about 10 MHz, whereby the deflected beam of electrons are scanned across the mask having an aperture at the scanning frequency, and whereby the beam of electrons passing through the aperture strike a target and cause a pulsed, high-voltage current in the target.

DRAWINGS

Figure 2:
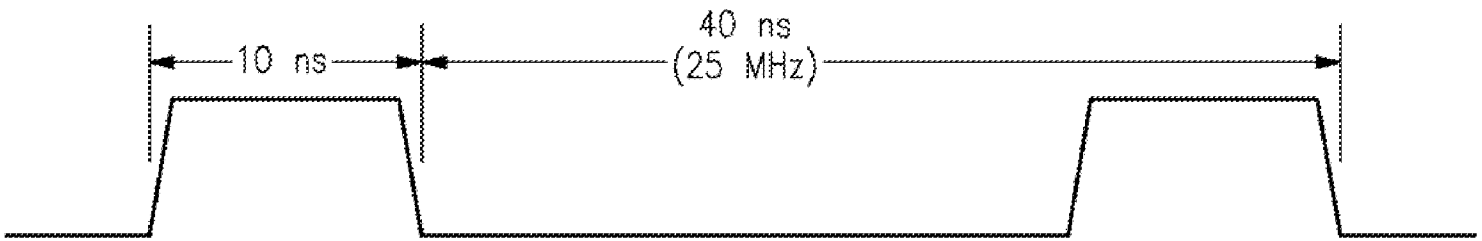

These and other features, aspects, and advantages of the present invention will become better understood when the following detailed description is read with reference to the accompanying drawings in which like characters represent like parts throughout the drawings, wherein:

FIG. 1 is a schematic view of a high-frequency, high-voltage electron switch according to an exemplary embodiment; and FIG. 2 is a graph of amplitude as a function of time for the exemplary embodiment.

DETAILED DESCRIPTION

Referring now to FIG. 1, a schematic representation of a high-frequency, high-voltage electron switch is generally shown at 10 according to an exemplary embodiment of the invention. In general, the electron switch 10 comprises an electron source 12, a steering mechanism 14, a mask 16 and a target 18.

The electron source 12 may comprise an electron gun that acts as a cathode and produces a high-energy, focused beam of electrons 20 having a beam energy or voltage $V_{beam}$ of at least about 1 kV and a beam current $I_{beam}$ of at least about 1 amp. The electron gun 12 can be charged up to about 100 kV, causing the electrons to hit the mask 16 with energies of about 100 kV. The electron gun 12 is at a higher voltage than the anode plate 16 (and target 18) for the beam of electrons 20 to be accelerated toward the target 18. In the exemplary embodiment, the electron gun 12 is a 2 kV electron gun that provides the focused beam of electrons 20 with a diameter of about one inch and having a beam voltage $V_{beam}$ of about 2 kV ±100V and a beam current $I_{beam}$ sufficient to produce about 1 kV in the transmission line load (10 amps into a 100 ohm line would give 1 kV), and conventional focusing and current modulating grids at voltages within a couple hundred volts of the cathode voltage. It will be appreciated that the invention is not limited by the electron source, and that the invention can be practiced with any desirable means for producing a high-voltage focused beam of electrons, such as a synchrotron, and the like.

The steering mechanism 14 may comprise a deflecting coil or yoke that causes electrostatic deflection of the beam of electrons 20. In the exemplary embodiment, the steering mechanism 14 is modulated with a sine wave having a frequency of about 12.5 MHz. Thus, in the exemplary embodiment, the steering mechanism 14 causes the beam of electrons 20 to scan across the mask 16 with a rate of about 25.0 MHz. It will be appreciated that the invention is not limited by the frequency of the steering mechanism 14, and that the frequency of about 12.5 MHz is only for illustration purposes. For example, the steering mechanism 14 may have a sine wave frequency of about 10.0 MHz or higher. The invention is not limited by the type of steering voltage, and the invention can be practiced with any desirable steering voltage, such as a square wave, a triangular wave, a saw tooth wave, and the like.

The mask 16 may comprise an actively cooled anode plate that accelerates the beam of electrons 20. The anode plate 16 may be actively cooled with any well-known means, such as water, and the like. The anode plate 16 includes a hole or aperture 22 for allowing the beam of electrons 20 to pass therethrough. For example, the anode plate 16 may be about 1 ft. in diameter with the hole or aperture 22 of about 1-2 inches (about 25-50 mm) in diameter. The anode plate 16, along with the electron gun 12 and the steering mechanism 14, are connected to ground. The anode plate 16 may be made of a material with suitable heat, wear and corrosion properties. One such group of materials may be refractory metals, such as tungsten, molybdenum, niobium, tantalum, rhenium, and the like.

The beam of electrons 20 that pass through the aperture or hole 22 in the anode plate 16 strike a surface or face 24 of the target 18. In the exemplary embodiment, the target 18 comprises a transmission line having an impedance Z. The transmission line 18 may be in electrical communication with a device (not shown) to provide high-voltage, high-repetition-rate pulsed current to the device.

As described above, the electron switch 10 is capable of turning on and off a high voltage source with a very high frequency or repetition rate and very fast rise times. It will be appreciated that the pulse amplitude, the pulse width and the rise time of the electron switch 10 can be selectively determined based on various parameters. Specifically, the pulse amplitude can be determined by the beam current $I_{beam}$ and the line impedance Z. The width of the pulse is determined by the size of the hole or aperture 22 and the scanning rate of the beam of electrons 20. The rise time is determined by the size and the scanning rate of the beam of electrons 20. Further, the pulse form can be sculpted by modifying the form of the hole or aperture 22 in the mask 16 together with the focus of the beam of electrons 20.

Referring now to FIG. 2, for example, the 2 kV electron gun 12 has a beam energy $V_{beam}$, of about 2 kV ±100V, a beam current $I_{beam}$ of about 20 amps, and e-beam control voltages within about 100 V of the electron gun 12. The steering mechanism 14 is driven with a sine wave frequency, for example, of about 12.5 MHz. The target 18 has an impedance of about 50 ohms, resulting in a voltage of about 1 kV under full beam current $I_{beam}$ conditions. In this example, the electron switch 10 produces an electrical current in the target 18 with a pulse amplitude of about 1 kV, a pulse width of approximately 10 ns, a frequency or repetition rate of about 40 ns (about 25 MHz), and a rise time of about one nanosecond. Thus, the electron switch 10 is capable of switching electrical current at high voltage (at least one kV) with a nanosecond rise time (about one to three nanoseconds) and a repetition rate of tens of megahertz (greater than about 10 MHz).

There are many applications that would benefit from the high-voltage, high-frequency or repetition rate, and fast rise time of the electron switch 10. For example, the electron switch 10 can efficiently drive plasmas. Other applications include, but are not limited to, food processing, water treatment, medical systems/imaging, and military applications.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An electron switch, comprising:

an electron source for emitting a beam of electrons having a beam energy or voltage $V_{beam}$ of at least about 1 kV and a beam current $I_{beam}$ of at least about 1 amp;

a steering mechanism for deflecting the beam of electrons at a scanning frequency of at least about 10 MHz; and a mask having an aperture, the deflected beam of electrons being scanned across the mask at the scanning frequency, wherein the beam of electrons passing through the aperture strikes a target and causes a pulsed, high-voltage current in the target.

2. The electron switch of claim 1, wherein the electron source comprises an electron gun.

3. The electron switch of claim 1, wherein the steering mechanism comprises an electrostatic yoke.

4. The electron switch of claim 1, wherein the target comprises a transmission line.

5. The electron switch of claim 1, wherein a pulse amplitude of the beam of electrons striking the target is determined by the beam current $I_{beam}$ and an impedance of the target.

6. The electron switch of claim 5, wherein the pulse amplitude is about 1 kV when the current of the beam of electrons is about 20 amps and the impedance of the target is about 50 ohms.

7. The electron switch of claim 1, wherein a pulse width of the beam of electrons striking the target is determined by a size of the aperture and the scanning frequency.

8. The electron switch of claim 7, wherein the pulse width is about 10 nanoseconds when the size of the aperture is about 2 inches (about 50 mm) and the scanning frequency is about 12.5 MHz.

9. The electron switch of claim 1, wherein a rise time of the beam of electrons striking the target is determined by a size of the beam of electrons and the scanning frequency.

10. The electron switch of claim 7, wherein the rise time is about one nanosecond when the size of the beam of electrons is about one inch and the scanning frequency is about 12.5 MHz.

11. A high-voltage, high frequency electron switch, comprising:

an electron gun that produces a beam of electrons with a voltage of at least about 1 kV;

an electrostatic yoke that deflects the beam of electrons at a scanning frequency of at least about 10 MHz; and an anode plate having an aperture, the beam of electrons passing through the aperture at twice the scanning frequency, wherein the beam of electrons passing through the aperture and striking a target produce a pulsed, high-voltage current in the target having a pulse amplitude determined by an impedance of the target and the current of the beam of electrons, a pulse width determined by a size of the aperture and the scanning frequency, and a rise time determined by a beam size and the scanning frequency.

12. The electron switch of claim 11, wherein the target comprises a transmission line.

13. The electron switch of claim 11, wherein the pulse amplitude is about 1 kV when the current of the beam of electrons is about 2 kV and the impedance is about 50 ohms.

14. The electron switch of claim 11, wherein the pulse width is about 10 nanoseconds when the size of the aperture is about 2 inches and the scanning frequency is about 12.5 MHz.

15. The electron switch of claim 11, wherein the rise time is about one nanosecond when the size of the beam of electrons is about one inch and the scanning frequency is about 12.5 MHz.

16. A method of making an electron switch, comprising the steps of:

emitting a beam of electrons having a beam energy or voltage $V_{beam}$ of at least about 1 kV and a current $I_{beam}$ of at least about 1 amp; and deflecting the beam of electrons at a scanning frequency of at least about 10 MHz, whereby the deflected beam of electrons are scanned across a mask having an aperture at the scanning frequency, and whereby the beam of electrons passing through the aperture strike a target and causes a pulsed, high-voltage current in the target.

17. The method of claim 16, further comprising the step of determining a pulse amplitude of the beam of electrons that strike the target based on the current $I_{beam}$ and an impedance of the target.

18. The method of claim 16, further comprising the step of determining a pulse width of the beam of electrons that strike the target based on a size of the aperture and the scanning frequency.

19. The method of claim 16, further comprising the step of determining a rise time of the beam of electrons that strike the target based on a size of the beam of electrons and the scanning frequency.

* * * * *